US007655887B2

(12) United States Patent
Chen et al.

(10) Patent No.: US 7,655,887 B2
(45) Date of Patent: Feb. 2, 2010

(54) FEEDBACK CONTROL SYSTEM AND METHOD FOR MAINTAINING CONSTANT RESISTANCE OPERATION OF ELECTRICALLY HEATED ELEMENTS

(75) Inventors: Ing-Shin Chen, Danbury, CT (US); Jeffrey W. Neuner, Bethel, CT (US); Richard Kramer, Sharon, MA (US)

(73) Assignee: Advanced Technology Materials, Inc., Danbury, CT (US)

( * ) Notice: Subject to any disclaimer, the term of this patent is extended or adjusted under 35 U.S.C. 154(b) by 75 days.

(21) Appl. No.: 11/440,241

(22) Filed: May 24, 2006

(65) Prior Publication Data

US 2006/0219698 A1 Oct. 5, 2006

Related U.S. Application Data

(63) Continuation of application No. 10/775,473, filed on Feb. 9, 2004, now Pat. No. 7,193,187.

(51) Int. Cl.
*H05B 1/02* (2006.01)

(52) U.S. Cl. ..... 219/505; 219/497; 219/202

(58) Field of Classification Search ..... 219/497, 219/505, 202, 205, 490, 499, 494; 374/144, 374/1; 73/23.32, 31.05, 31.06
See application file for complete search history.

(56) References Cited

U.S. PATENT DOCUMENTS 3,464,269 A 9/1969 Froger
4,305,724 A * 12/1981 Micko ..... 436/156
4,533,520 A * 8/1985 Bossart et al. ..... 422/96
4,587,104 A 5/1986 Yannopoulos
4,601,883 A 7/1986 Sekido et al.
4,685,325 A 8/1987 Warchol
4,829,819 A 5/1989 Lefteriou et al.
5,012,432 A 4/1991 Stetter et al.
5,081,869 A * 1/1992 Hachey et al. ..... 73/25.03
5,360,266 A * 11/1994 Lenfers et al. ..... 374/36
5,535,614 A * 7/1996 Okamoto et al. ..... 73/23.31
5,627,305 A 5/1997 Yun et al.
5,811,662 A 9/1998 Williams et al.
5,834,627 A 11/1998 Ricco et al.
6,207,008 B1 3/2001 Kijima
6,812,708 B2 11/2004 Bristol
6,923,054 B2 8/2005 Liu et al.

(Continued)

FOREIGN PATENT DOCUMENTS

CN 1160848 A 10/1997

*Primary Examiner*—Mark H Paschall
(74) *Attorney, Agent, or Firm*—Vincent K. Gustafson; Intellectual Property Technology Law; Maggie Chappuis

(57) ABSTRACT

A system and method for controlling electrical heating of an element to maintain a constant electrical resistance, by adjusting electrical power supplied to such element according to an adaptive feedback control algorithm, in which all the parameters are (1) arbitrarily selected; (2) pre-determined by the physical properties of the controlled element; or (3) measured in real time. Unlike the conventional proportion-integral-derivative (PID) control mechanism, the system and method of the present invention do not require re-tuning of proportionality constants when used in connection with a different controlled element or under different operating conditions, and are therefore adaptive to changes in the controlled element and the operating conditions.

19 Claims, 3 Drawing Sheets

U.S. PATENT DOCUMENTS

| | | | | |
|---|---|---|---|---|
| 7,036,982 | B2 | 5/2006 | Smith et al. | |
| 7,080,545 | B2 | 7/2006 | Dimeo, Jr. et al. | |
| 7,228,724 | B2 | 6/2007 | Chen et al. | |
| 7,296,458 | B2 | 11/2007 | Dimeo, Jr. et al. | |
| 7,296,460 | B2 | 11/2007 | Dimeo, Jr. et al. | |
| 7,475,588 | B2 | 1/2009 | Dimeo, Jr. et al. | |
| 2004/0074285 | A1 | 4/2004 | Dimeo, Jr. et al. | |
| 2004/0113802 | A1* | 6/2004 | Green et al. | 340/632 |
| 2004/0163445 | A1 | 8/2004 | Dimeo, Jr. et al. | |
| 2005/0173407 | A1 | 8/2005 | Chen et al. | |
| 2005/0230258 | A1* | 10/2005 | Dimeo et al. | 205/78 |

* cited by examiner

FEEDBACK CONTROL SYSTEM AND METHOD FOR MAINTAINING CONSTANT RESISTANCE OPERATION OF ELECTRICALLY HEATED ELEMENTS

CROSS REFERENCE TO RELATED APPLICATION

This is a continuation of U.S. patent application Ser. No. 10/775,473 filed Feb. 9, 2004 and subsequently issued as U.S. Pat. No. 7,193,187 on Mar. 20, 2007 in the names of Ing-Shin Chen, et al. for "FEEDBACK CONTROL SYSTEM AND METHOD FOR MAINTAINING CONSTANT RESISTANCE OPERATION OF ELECTRICALLY HEATED ELEMENTS." Priority of said U.S. patent application Ser. No. 10/775,473 is hereby claimed under the provisions of 35 U.S.C. §120.

GOVERNMENT INTEREST

The U.S. government may own rights in the present invention, pursuant to Contract No. 70NANB9H3018 entitled "Integrated MEMS Reactor Gas Monitor Using Novel Thin Film Chemistry for the Closed Loop Process Control and Optimization of Plasma Etch and Clean Reactions in the Manufacturing of Microelectronics".

BACKGROUND OF THE INVENTION

1. Field of the Invention

The present invention relates to an adaptive feedback control system and method for controlling electrical heating of an element and maintaining constant resistance operation thereof, specifically to a gas-sensing system and method for determining presence and concentration of a target gas species based on the amount of adjustment required for maintaining an electrical gas sensor element at a constant electrical resistance.

2. Description of the Related Art

Combustion-based gas sensors comprising heated noble metal filaments are widely used for detecting the presence and concentration of a combustible gas species of interest. Catalytic combustion of such gas species is induced on the surface of such heated noble metal filaments, resulting in detectable changes in the temperature of such filaments. Each gas sensor usually comprises a matching pair of filaments: a first filament—known as the detector—actively catalyzes combustion of the target gas species and causes temperature changes, and a second filament—known as the compensator—does not contain the catalytic material and therefore only passively compensates for changes in the ambient conditions. When such pair of filaments is incorporated into a Wheatstone-Bridge circuit, an out-of-balance signal can be produced to indicate the presence of the target gas species.

Because it is often desirable to operate the combustion-based gas sensors at a prescribed temperature so as to maintain a known, constant rate of combustion, the conventional gas sensors utilize a feedback control circuit for adjusting the electrical power supplied to the heated noble metal filaments to compensate for the temperate changes caused by combustion. In other words, the more heat generated by the combustion, the more adjustment is required to maintain the constant temperature operation, and the less heat generated by the combustion, the less adjustment is required. In such manner, the presence as well as concentration of the gas species can be determined based on the amount of adjustment required for maintaining the detector and the compensator at constant temperatures (i.e., if no adjustment is required, then there is no target gas species present; the greater the adjustment required, the higher the concentration of such gas species).

Because the temperature of a metal filament directly impacts its electrical resistance, which can be precisely measured by various electrical devices, the feedback control circuit used by the conventional gas sensors usually provides an electrical resistance setpoint ($R_s$) as an input (r), and monitors the electrical resistances (R) of the metal filament as an output (c) indicative of temperature changes in such filament, while the output electrical resistance (R) is also used as a feedback signal for adjusting the electrical current passed through the filament to compensate for any temperature changes detected. Specifically, the differences between such input set point resistance ($R_s$) and the feedback signal of the output electrical resistance (R) are recorded as an error signal ($e=R_s-R$), on the basis of which a control signal (u) is determined and used for manipulating the electrical power supplied to the metal filaments so as to reduce the error signal (e).

The well-known proportion-integral-derivative (PID) feedback control system determines the control signal (u) as a function of the error signal (e), which contains three terms including (1) a proportional term ($K_P \times e$), (2) an integral term ($K_I \times \int e(t)dt$), and (3) a derivative term $$\left(K_D \times \frac{de}{dt}\right).$$

The proportional term ($K_P \times e$) is proportional to the error signal (e), where $K_P$ is its proportionality constant. The integral term ($K_I \times \int e(t)dt$) is proportional to the time integral of the error signal (e), where $K_I$ is its proportionality constant. The derivative term $$\left(K_D \times \frac{de}{dt}\right)$$

is proportional to the time derivative of the error signal (e), where $K_D$ is its proportionality constant.

A major drawback and limitation of the conventional PID feedback control system lies in the need to empirically tune the proportionality constants ($K_P$, $K_I$, and $K_D$) for each controlled element at a specific set of operating conditions, since optimal values of such proportionality constants vary significantly from element to element and at various operating conditions. Therefore, whenever the controlled elements or the operating conditions change, such proportionally constants ($K_P$, $K_I$, and $K_D$) have to be re-tuned. When such PID feedback control system is used for controlling the combustion-based gas sensors, in which addition/removal/replacement of sensor elements are frequent and the operating conditions constantly change due to fluctuations in gas concentration, pressure, temperature, humidity, etc., the task of re-tuning becomes labor-intensive and cumbersome.

It is therefore an object of the present invention to provide a feedback control system and method for maintaining constant resistance operation of combustion-based gas sensors, which is adaptive to variations in the sensor elements and in the operating conditions and requires minimum or no re-tuning when the sensor elements or the operating conditions change.

It is also an object of the present invention to provide an adaptive feedback control system and method for maintaining constant resistance operation of electrically heated elements in general.

Other aspects, features and advantages of the invention will be more fully apparent from the ensuing disclosure and appended claims.

SUMMARY OF THE INVENTION

The present invention in one aspect relates to a method for controlling electrical heating of an element to maintain a constant electrical resistance $R_s$, comprising:

(a) supplying electrical power to such element in an amount sufficient for heating same and increasing its electrical resistance to $R_s$, while concurrently monitoring real time electrical resistance R of such element for detection of any difference between R and $R_s$;

(b) upon detection of a difference between R and $R_s$, adjusting the electrical power supplied to such element by an amount ΔW, which is determined by:

$$\Delta W = \frac{m}{\alpha_p \times t \times R_0} \cdot (R_s - R); \quad \text{(i)}$$

$$\Delta W = \frac{m}{\alpha_p \times t \times R_0} \cdot [R_s + R(0) - 2R]; \text{ or} \quad \text{(ii)}$$

$$\Delta W = \frac{m}{\alpha_p \times R_0} \cdot \left[f_s(R_s - R) - \frac{R - R(0)}{t}\right], \quad \text{(iii)}$$

wherein m is the thermal mass of such element, $\alpha_p$ is the temperature coefficient of electrical resistance of such element, $R_0$ is the standard electrical resistance of such element measured at a reference temperature, t is the time interval between current detection of electrical resistance difference and last adjustment of electric power, R(0) is the electrical resistance of such element measured at last adjustment of electric power, and $f_s$ is a predetermined frequency at which the adjustment of electric power is periodically carried out.

A first embodiment of the present invention relates to a passive adaptive feedback control mechanism, which detects the difference between R and $R_s$, and adjusts the electrical power provided to the element for passively compensating such already-occurred resistance change to restore the electrical resistance of the element back to $R_s$. In such passive adaptive feedback control mechanism, the electrical power adjustment ΔW is determined by:

$$\Delta W = \frac{m}{\alpha_p \times t \times R_0} \cdot (R_s - R).$$

A second embodiment of the present invention relates to an active adaptive feedback control mechanism, which recognizes the delay between detection of the electrical resistance change and the adjustment of electrical power, estimates the amount of resistance change that will occur between the present time and a predetermined future time, and adjusts the electrical power provided to the element for actively compensating not only the already-occurred resistance change but also the estimated future resistance change, to restore the electrical resistance of the element back to $R_S$ for the future time. Depending on specific choices of such future time, such active adaptive feedback control mechanism can determine the amount of power adjustment ΔW as follows:

When the future time is set at not less than the time interval t between current detection of electrical resistance difference and last adjustment of electric power, ΔW is approximately:

$$\Delta W = \frac{m}{\alpha_p \times t \times R_0} \cdot [R_s + R(0) - 2R].$$

When periodic adjustment of the electrical power is provided at a predetermined frequency $f_s$, the future time is equal to the adjustment interval $1/f_s$, and ΔW is approximately:

$$\Delta W = \frac{m}{\alpha_p \times R_0} \cdot \left[f_s(R_s - R) - \frac{R - R(0)}{t}\right].$$

A major advantage of the adaptive feedback control mechanism of the present invention over the conventional PID feedback control mechanism is that all the parameters used in the above-described functions for determining the control signal (namely the adjustment of electrical power ΔW) are (1) arbitrarily selected (such as $R_s$ and $f_s$); (2) predetermined by the physical properties of the controlled element (such as m, $\alpha_p$, and $R_0$); or (3) measured in real time (such as R(0), R, and t) during the operation. No empirical re-tuning is required for determining the control signal for maintaining such controlled element at constant resistance operation, regardless of the changes in the controlled element and the operating conditions, which significantly reduces the operating costs and increases the operating flexibility. Moreover, those parameters predetermined by the physical properties of the controlled element (such as m, $\alpha_p$, and $R_0$) only need to be measured once and subsequently apply to all elements of similar construction, which further reduces the system adjustment required in the events of addition/removal/replacement of controlled elements.

The adjustment of electric power can be carried out in the present invention by adjusting either the electrical current passed through the controlled element or the electrical voltage applied on such element.

Specifically, the electrical current passed through the controlled element can be adjusted by an amount ΔI, determined approximately by:

$$\Delta I = \frac{\Delta W}{2IR_s},$$

wherein I is the electrical current passed through the element before such adjustment.

Alternatively, the electrical voltage applied on such element can be adjusted by an amount ΔV, determined approximately by:

$$\Delta V = \frac{\Delta W \cdot R_s}{2V},$$

wherein V is the electrical voltage applied on the element before the adjustment.

In a preferred embodiment of the present application, the controlled element is an electrical gas sensor for monitoring an environment susceptible to presence of a target gas species. Specifically, such gas sensor has a catalytic surface that can effectuate exothermic or endothermic reactions of the target gas species at elevated temperatures. Therefore, the presence of such target gas species in the environment causes temperature change as well as electrical resistance change in the gas sensor, which responsively effectuates the adjustment of electrical power supplied to the gas sensor, as described hereinabove. The amount of electrical power adjustment required for maintaining such gas sensor at constant resistance operation correlates to and is indicative of the presence and concentration of the target gas species in the environment.

The above-described electrical gas sensor preferably comprises one or more gas-sensing filaments having a core formed of chemically inert and non-conductive material and a coating thereon formed of electrically conductive and catalytic material. More preferably, the coating of such gas sensing-filaments comprises a noble metal thin film, such as a Pt thin film, as disclosed by U.S. Pat. No. 7,080,545 for "APPARATUS AND PROCESS FOR SENSING FLUORO SPECIES IN SEMICONDUCTOR PROCESSING SYSTEMS" issued on Jul. 25, 2006, in the names of Frank Dimeo Jr., Philip S. H. Chen, Jeffrey W. Neuner, James Welch, Michele Stawasz, Thomas H. Baum, Mackenzie E. King, Ing-Shin Chen, and Jeffrey F. Roeder, the disclosure of which are incorporated herein by reference in its entirety for all purposes.

As used herein, the term "fluoro species" is intended to be broadly construed to encompass all fluorine-containing materials, including without limitation, gaseous fluorine compounds, fluorine per se in atomic and diatomic (F) forms, fluorine ions, and fluorine-containing ionic species. The fluoro species may for example include species such as $NF_3$, $SiF_4$, $C_2F_6$, HF, $F_2$, $COF_2$, $ClF_3$, $IF_3$, etc., and activated fluorine-containing species (denoted collectively as $F^{\bullet}$) thereof, including ionized fragments, plasma forms, etc.

When used for detecting a reactive gas species of interest, such filament sensor is first pre-heated in an inert environment (i.e., devoid of the target gas species) for a sufficient period of time until it reaches a steady state, which is defined as a state where the heating efficiency and the ambient temperature surrounding such filament sensor become stable, and where the rate of temperature change on such filament sensor equals about zero. The electrical resistance of such sensor at the steady state is then determined, which is to be used as the setpoint or constant resistance value $R_s$ in subsequent constant resistance operation. Subsequently, the filament sensor is exposed to an environment that is susceptible to the presence of the target gas species. Detectible changes in the electrical resistance of such filament sensor (i.e., detectable deviation from the setpoint resistance value $R_s$) will be observed if the target gas species is present in the environment, since exothermic or endothermic reactions of the target gas species on the heated catalytic surface of the filament-based gas sensor cause temperature changes in such gas sensor. The adaptive feedback control mechanism as described hereinabove correspondingly adjusts the electrical power supplied to such filament sensor and maintains the electrical resistance of the filament sensor at the setpoint or constant value $R_s$.

In such manner, the setpoint or constant resistance value $R_s$ is re-set at each detection or gas-sensing cycle, and the measurement errors caused by long-term drifting can be effectively eliminated. Further, since the filament-based gas sensor has already been pre-heated and reached an electrical resistance equal to the setpoint or constant value before exposure to the target gas species, the time delay usually caused by "warming-up" of the instruments is significantly reduced or completely eliminated.

Another aspect of the present invention relates to a system for controlling electrical heating of an element and maintaining same at a constant electrical resistance $R_s$, comprising:

(a) an adjustable electricity source coupled with such element for providing electrical power to heat such element;

(b) a controller coupled with the element and the electricity source, for monitoring real time electrical resistance R of such element, and upon detection of a difference between R and $R_s$, for responsively adjusting the electrical power supplied to the element by an amount ΔW determined approximately by:

$$\Delta W = \frac{m}{\alpha_p \times t \times R_0} \cdot (R_s - R); \quad \text{(i)}$$

$$\Delta W = \frac{m}{\alpha_p \times t \times R_0} \cdot [R_s + R(0) - 2R]; \text{ or} \quad \text{(ii)}$$

$$\Delta W = \frac{m}{\alpha_p \times R_0} \cdot \left[f_s(R_s - R) - \frac{R - R(0)}{t}\right], \quad \text{(iii)}$$

wherein m is the thermal mass of the element, $\alpha_p$ is the temperature coefficient of electrical resistance of the element, $R_0$ is the standard electrical resistance of the element measured at a reference temperature, t is the time interval between current detection of electrical resistance difference and last adjustment of electric power, R(0) is the electrical resistance of the element measured at last adjustment of electric power, and $f_s$ is a predetermined frequency at which the adjustment of electric power is periodically carried out.

Preferably, the controller comprises one or more devices for monitoring the electrical resistance of the controlled element, which may be an electrical resistance meter, or alternatively, a current meter used in conjunction with a voltage meter $$\left(R = \frac{V}{I}\right).$$

A still further aspect of the present invention relates to a gas-sensing system for detecting a target gas species, comprising:

(a) an electrical gas sensor element having a catalytic surface that effectuates exothermic or endothermic reactions of the target gas species at elevated temperatures;

(b) an adjustable electricity source coupled with the gas sensor element for providing electrical power to heat such gas sensor element;

(c) a controller coupled with the gas sensor element and the electricity source, for adjusting the electrical power supplied to such gas sensor element to maintain a constant electrical resistance $R_s$; and (d) a gas composition analysis processor connected with the controller, for determining the presence and concentration of the target gas species, based on the adjustment of electrical power required for maintaining the constant electrical resistance $R_s$, wherein the electrical power is adjusted upon detection of an electrical resistance change in the gas sensor element, by an amount ΔW determined approximately by:

$$\Delta W = \frac{m}{\alpha_p \times t \times R_0} \cdot (R_s - R); \quad \text{(i)}$$

$$\Delta W = \frac{m}{\alpha_p \times t \times R_0} \cdot [R_s + R(0) - 2R]; \text{ or} \quad \text{(ii)}$$

$$\Delta W = \frac{m}{\alpha_p \times R_0} \cdot \left[f_s - (R_s - R) - \frac{R - R(0)}{t}\right], \quad \text{(iii)}$$

in which m is the thermal mass of such gas sensor element, $\alpha_p$ is the temperature coefficient of electrical resistance of such gas sensor element, $R_0$ is the standard electrical resistance of such gas sensor element measured at a reference temperature, t is the time interval between current detection of electrical resistance change and last adjustment of electric power, R is the electrical resistance of such gas sensor element measured at current time, R(0) is the electrical resistance of such gas sensor element measured at last adjustment of electric power, and $f_s$ is a predetermined frequency at which the adjustment of electric power is periodically carried out.

Yet another aspect of the present invention relates to a method for detecting presence of a target gas species in an environment susceptible to the presence of same, comprising the steps of:

(a) providing an electrical gas sensor element having a catalytic surface that effectuates exothermic or endothermic reactions of the target gas species at elevated temperatures;

(b) pre-heating the gas sensor element in an inert environment devoid of the target gas species for a sufficient period of time, so as to reach a steady state;

(c) determining electrical resistance $R_s$ of such gas sensor element at the steady state;

(d) placing the gas sensor element in the environment susceptible to the presence of the target gas species;

(e) adjusting electric power that is supplied to the gas sensor element so as to maintain the electrical resistance of such gas sensor element at $R_s$; and (f) determining the presence and concentration of the target gas species in the environment susceptible of such gas species, based on the adjustment of electrical power required for maintaining the electrical resistance $R_s$.

Other aspects, features and embodiments of the invention will be more fully apparent from the ensuing disclosure and appended claims.

DETAILED DESCRIPTION OF THE INVENTION AND PREFERRED EMBODIMENTS THEREOF

Figure 1:
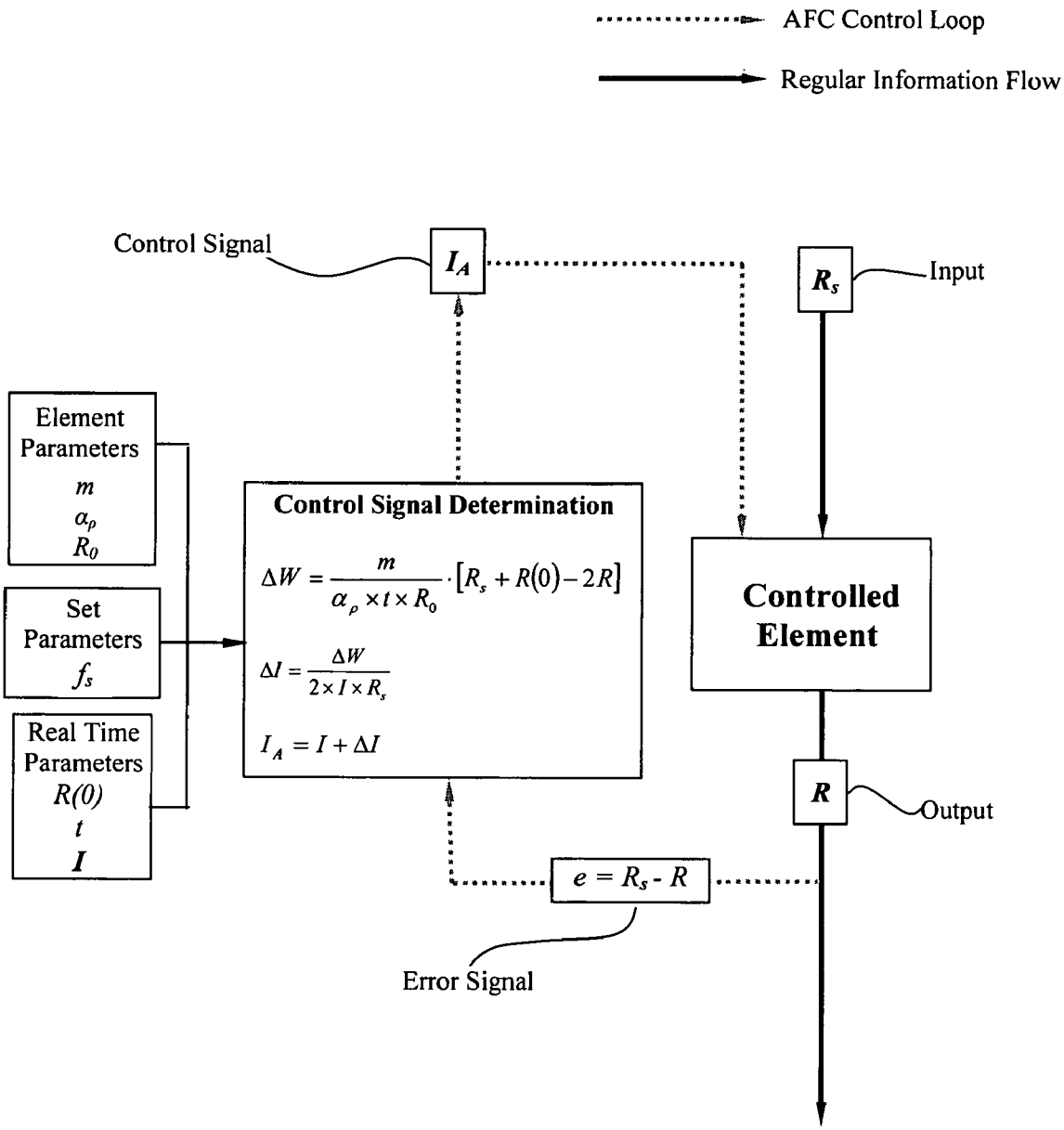
FIG. 1 is a diagram illustrating an adaptive feedback control mechanism that adjusts the electrical current passed through an electrically heated element for maintaining constant resistance operation, according to one embodiment of the present invention.

U.S. Pat. No. 7,080,545 for "APPARATUS AND PROCESS FOR SENSING FLUORO SPECIES IN SEMICONDUCTOR PROCESSING SYSTEMS" issued on Jul. 25, 2006, and U.S. Pat. No. 5,834,627 to Ricco et al, are hereby incorporated by reference in their respective entireties for all purposes.

The term "steady state" as used herein refers to a state where the heating efficiency and the ambient temperature surrounding the electrically heated element are stable, and where the rate of temperature change on such heated element equals about zero.

The term "thermal mass" as used herein is defined as the product of specific heat, density, and volume of said electrically heated element.

The term "specific heat" as used herein refers to the amount of heat, measured in calories, required to raise the temperature of one gram of a substance by one Celsius degree.

In constant resistance operation, the feedback control mechanism is aimed at maintaining the heated element at constant resistance, irrespective of variations in joule heating or power perturbation in the surrounding environment.

Due to a well-defined resistance-temperature correlation for electrically heated elements, electrical resistance directly correlates with the temperature of such elements, and vice versa, according to the following equation:

$$R = R_0 \cdot [l + \alpha_p (T - T_0)]$$

where $R_0$ is the standard electrical resistance of the element measured at a reference temperature $T_0$, $\alpha_p$ is the temperature coefficient of electrical resistance of such element. The above equation describes the linear dependence of temperature over the electrical resistance.

In the situation when variations in the heat loss mechanism and ambient temperature are negligible, a constant power flux on the element results in a constant temperature and therefore a constant electrical resistance, and the system reaches the steady state.

However, when the power flux on the element fluctuates, for example due to exothermic or endothermic chemical reactions of such element with a gas species in the surrounding environment, the temperature and the electrical resistance of such element change correspondingly. In order to maintain constant resistance operation, it is necessary to adjust the electrical power supplied to such element to compensate for the fluctuation in the total power flux experienced by such element.

A set of adaptive feedback control (AFC) algorithms are provided herein for determining the amount of electrical power adjustment required for maintaining the constant resistance operation of such electrically heated element, based on either physical parameters of such element or parameters that can be measured in real time during the operation. The AFC algorithms of the present invention do not contain any parameters that have to be determined by empirical testing or tuning; therefore, re-tuning of such algorithms is not necessary when the controlled element itself or the operating conditions change, which significantly reduces the system adjustments required, in comparison with the convention PID algorithms.

In general, the differential equation governing the temperature responses of an electrically heated element is:

$$\frac{dT}{dt} = \frac{\eta \cdot W - (T - T_a)}{\tau} = \frac{\eta \cdot (I^2 R + W_{perturbation}) - (T - T_a)}{\tau} A$$

wherein dT/dt is the time derivative of temperature changes (i.e., the rate of temperature changes) for such heated element measured at any specific point of time, $\eta$ is the heating efficiency of such element, W is the total power flux experienced by such element, T is the temperature of the element, $T_a$ is the ambient temperature, $\tau$ is the $\eta \cdot m$ product that describes the time it takes to heat up the thermal mass m ($m=C_p \cdot D \cdot V_s$, where $C_p$, D, and $V_s$ are the specific heat, density, and volume of the heated element, respectively), I is the electrical current passed through such element for heating thereof, R is the electrical resistance of the heated element, and $W_{perturbation}$ is the power perturbation exerted upon the heated element as caused by factors other than electrical heating.

At a steady state (i.e., dT/dt=0) where only electrical heating is present, the electrical current of the heated element is at a constant value $I_c$, and the steady state temperature $T_c$ is:

$$T_c = T_a + \eta W = T_a + \eta \cdot I_c^2 R_c = T_a + \eta \cdot I_c^2 R_0 \cdot [l + \alpha_p (T_c - T_0)]$$

wherein $R_c$ is the electrical resistance of the heated element at the steady state.

If solving $T_c$, then:

$$T_c = \left. \frac{T_a + \eta I^2 R_0 - \alpha_p \eta I^2 R_0 T_0}{1 - \alpha_p \eta I^2 R_0} \right|_{I=I_c, T_a=T_{a,c}, \eta=\eta_c}$$
$$= (T_a' + \eta' W')\,|_{I=I_c, T_a=T_{a,c}, \eta=\eta_c, W_{perturbation}=0}$$

where $$\epsilon = \alpha_p \eta I^2 R_0$$

$$T_a' = (T_a - \epsilon T_0)/(l - \epsilon),\ \eta' = \eta/(1 - \epsilon),\ W' = I^2 R_0 + W_{perturbation}$$

and $T_{a,c}$ and $\eta_c$ are the ambient temperature and heating efficiency at the time when $T_c$ is determined. The respective setpoint $R_s$ for constant resistance operation can be determined at the same time, preferably as being equal or close to the steady state resistance value $R_c$ of the heated element.

The feedback control mechanism of the present invention aims at keeping the real time electrical resistance R of the heated element at a setpoint or constant resistance value $R_s$, by varying the electrical power supplied to such element.

Specifically, the setpoint or constant resistance value $R_s$ is provided as an input signal, and the real time electrical resistance R of the heated element is monitored as an output signal, which can be compared with the input signal $R_s$. Any detectable difference between the input $R_s$ and the output R is treated as an error signal e($=R_s-R$). Such error signal e responsively invokes the feedback control mechanism to produce a control signal, which is used for manipulating the system (i.e., feedback) in order to minimize the error signal e.

In the present invention, the control signal used for manipulating the system is $\Delta W$, which represents adjustment of the electrical power supplied to the heated element for reducing the difference between R and $R_s$ and which is determined by the following AFC algorithms:

Passive AFC Algorithm

In this simplified embodiment of the invention, it is assumed that the heated element is constantly in a quasi-steady state (QSS) with very small power and temperature fluctuations, so that equations that govern the steady state behavior can be applied. Within this framework, constant power operation and constant resistance operation are functionally equivalent while $T_{a,c} \approx T$ and $\eta_c \approx \eta$. Additionally, $W_{perturbation}$ is assumed to change very slowly over time so that it can be considered as time-invariant between the present time and next electrical power adjustment.

First, the real time resistance R measured for the heated element is:

$$R \approx R_0 \cdot \{l + \alpha_p [(T_a + \eta \cdot W) - T_0]\}$$

from which the total power flux W experienced by such element can be derived as:

$$W \approx \frac{R - R_0}{\alpha_p \cdot \eta \cdot R_0} + \frac{T_0 - T_a}{\eta}$$

For constant resistance operation of the element, a constant electrical resistance value $R_s$ is selected or predetermined, which bears the following relationship with the total power $W_s$ required for maintaining $R_s$:

$$R_s = R_0 \cdot \{l + \alpha_p [(T_{a,s} + \eta_s \cdot W_s) - T_0]\} \approx R_0 \cdot \{l + \alpha_p [(T_a + \eta \cdot W_s) - T_0]\}$$

from which the total power flux $W_s$ required for maintaining $R_s$ is:

$$W_s \approx \frac{R_s - R_0}{\alpha_p \cdot \eta \cdot R_0} + \frac{T_0 - T_a}{\eta}$$

The electric power adjustment $\Delta W$ required for maintaining the heated element at the constant electrical resistance $R_s$ is:

$$\Delta W = W_s - W \approx \frac{R_s - R}{\alpha_p \cdot \eta \cdot R_0} = \frac{m}{\tau} \cdot \frac{R_s - R}{\alpha_p \cdot R_0}$$

With the exception of $\tau$, all other parameters are determined either by the physical characteristics of the element (such as m, $\alpha_p$, and $R_0$), or by real time (such as R), or predetermined (such as $R_s$).

To further simplify the algorithm, $\tau$ is assumed to approximately equal t, which is the time interval between the present time and the last electrical power adjustment, so as to obtain:

$$\Delta W \approx \frac{m}{t} \cdot \frac{R_s - R}{\alpha_p \cdot R_0}$$

Such AFC algorithm is referred to as the passive AFC algorithm, because it adjusts the electrical power in an amount that is sufficient for passively compensating the detected resistance change that has already occurred (i.e., from the last electrical power adjustment to the present time), without considering the adjustment delay (i.e., the time when the electrical resistance change occurs and the time when the feedback control action is actually invoked).

Active AFC Algorithms

To improve upon the passive AFC algorithm, the following algorithms are provided for estimating ΔW necessary to actively compensate not only the resistance change that has already occurred but also the resistance changes that will occur between the present time and a future time:

Between time 0 (i.e., the time of last electrical power adjustment) and the present time t, the time derivative of temperature of the heated element is:

$$\frac{dT}{dt} = \frac{1}{\alpha_\rho \cdot R_0}\frac{dR}{dt} \approx \frac{1}{\alpha_\rho \cdot R_0} \cdot \frac{R - R(0)}{t}$$

wherein R(0) is the electrical resistance measured at time 0.

When t<<τ (i.e., the detection of electrical resistance change is approximately instant), the total power W experienced by such heated element at the present time is approximately:

$$W \approx \frac{1}{\eta}\left[\tau \cdot \frac{dT}{dt} + (T - T_a)\right] = \frac{m}{\alpha_\rho \cdot R_0}\left[\frac{R - R(0)}{t} + \frac{R - R_a}{\tau}\right]$$

wherein $R_a$ is the electrical resistance of the element measured at ambient temperature.

In order to estimate the power adjustment ΔW required to return R to $R_s$ at a future time, which can be referred to as t+Δt, the algorithm has to be modified based on the specific choice of Δt, as follows:

A. Relaxed Choice with Δt→∞

This situation is equivalent to a constant power operation in which $$R_s \approx R_0 \cdot \{l + \alpha_p[(T_a + \eta \cdot W_s) - T_0]\} = R_a + \alpha_p \eta \cdot R_0 \cdot W_s$$

and therefore, $$W_s \approx \frac{R_s - R_a}{\alpha_\rho \cdot \eta_s \cdot R_0} \approx \frac{m}{\tau} \cdot \frac{R_s - R_a}{\alpha_\rho \cdot R_0}$$

The required power adjustment ΔW is determined as:

$$\Delta W = W_s - W \approx \frac{m}{\tau} \cdot \frac{R_s - R_a}{\alpha_\rho \cdot R_0} - \frac{m}{\alpha_\rho \cdot R_0}\left[\frac{R - R(0)}{t} + \frac{R - R_a}{\tau}\right] = \frac{m}{\alpha_\rho \cdot R_0} \cdot \left[\frac{R_s - R}{\tau} - \frac{R - R(0)}{t}\right]$$

Since the electrical power adjustment is relatively relaxed, τ is approximately equal to t, and therefore:

$$\Delta W \approx \frac{m}{\alpha_\rho \cdot R_0} \cdot \left[\frac{R_s - R}{t} - \frac{R - R(0)}{t}\right] = \frac{m}{\alpha_\rho \cdot t \cdot R_0} \cdot (R_s + R(0) - 2R)$$

B. Balanced Choice Δt=t and Aggressive Choice Δt=1/$f_s$

For Δt<<τ (in which situation constant power operation does not apply) in general, $$\left.\frac{dT}{dt}\right|_{\Delta t>0} \approx \frac{R - R(0)}{\alpha_\rho \cdot t \cdot R_0} + \frac{\eta \cdot \Delta W}{\tau}$$

$$\begin{aligned} R(t + \Delta t) &\approx R + \Delta t \frac{dR}{dt} \\ &\approx R + \Delta t \cdot R_0 \cdot \alpha_\rho \frac{dT}{dt} \\ &\approx R + \frac{\Delta t}{t} \cdot [R - R(0)] + \frac{\Delta t}{\tau} \cdot \alpha_\rho \cdot R_0 \cdot \eta \Delta W \end{aligned}$$

Solving ΔW from the above equation:

$$\Delta W \approx \frac{m}{\alpha_\rho \cdot R_0} \cdot \left[\frac{R_s - R}{\Delta t} - \frac{R - R(0)}{t}\right]$$

If Δt is set to equal t, then the power adjustment ΔW is:

$$\Delta W \approx \frac{m}{\alpha_\rho \cdot t \cdot R_0} \cdot (R_s + R(0) - 2R)$$

In this embodiment, the power perturbation is actively adjusted for the future, based on the rate that it has occurred in the past. In other words, since it took an elapsed interval t to trigger the feedback control action, the system seeks to compensate for the perturbation in the same time interval t.

In an alternative embodiment, the feedback control mechanism provides periodic power adjustment according to a predetermined frequency $f_s$, and the system therefore seeks to compensate for the perturbation at the next adjustment cycle, which means that Δt=1/$f_s$. The power adjustment ΔW required therefore becomes:

$$\Delta W \approx \frac{m}{\alpha_\rho \cdot R_0} \cdot \left[f_s(R_s - R) - \frac{R - R(0)}{t}\right]$$

In summary, four different algorithms for estimating the electrical power adjustment ΔW are obtained by the present invention, based on different approximations, as follows:

$$\Delta W_{QSS} \approx \frac{m}{\alpha_\rho \cdot t \cdot R_0} \cdot (R_s - R)$$

$$\Delta W_{relaxed} \approx \frac{m}{\alpha_\rho \cdot t \cdot R_0} \cdot [R_s + R(0) - 2R]$$

$$\Delta W_{balanced} \approx \frac{m}{\alpha_\rho \cdot t \cdot R_0} \cdot [R_s + R(0) - 2R]$$

$$\Delta W_{agressive} \frac{m}{\alpha_\rho \cdot R_0} \cdot \left[f_s(R_s - R) - \frac{R - R(0)}{t}\right]$$

Despite the different approximations employed for the Relaxed and Balanced situations, the Relaxed AFC and the Balanced AFC algorithms are the same in the final estimate.

Therefore, when the future time Δt is set as being equal to or larger than t, ΔW can be determined as:

$$\Delta W = \frac{m}{\alpha_p \times t \times R_0} \cdot [R_s + R(0) - 2R],$$

which is a particularly preferred embodiment of the present invention.

Compared to the relaxed/balanced algorithm, the QSS algorithm requires one less register (i.e., R(0)) that the other algorithms for estimating the required power adjustment, which can therefore be adopted by systems with limited computational resources. Further, if assuming $R(\mathbf{0}) \approx R_s$ (i.e., each power adjustment fully restores the electrical resistance of the element back to the constant value $R_s$), the power adjustment estimated by the passive QSS algorithm is exactly one half of the adjustment estimated by the relaxed/balanced algorithms.

The Aggressive AFC algorithm provides the fastest feedback action when the adjustment frequency $f_s$ is sufficiently large, and therefore is best suited for use in a rapid varying environment.

In another embodiment of the present invention, a proportionality factor r can be used to modify the power adjustment ΔW calculated by the above-listed algorithms, in order to further optimize the feedback control results in specific operating systems and environments. Such proportionality factor r may range from about 0.1 to 10 and can be readily determined by a person ordinarily skilled in the art via routine system testing without undue experimentation.

To achieve the electrical power adjustment that has been estimated as hereinabove, two adjustment mechanisms can be used alternatively, which include a current adjustment mechanism and a voltage adjustment mechanism.

Current Adjustment

In this embodiment, the electrical current (I) passed through the heated element is adjusted by an amount (ΔI) to achieve the adjustment in electrical power ΔW, wherein:

$$\Delta W = (I+\Delta I)^2 \cdot R_s - I^2 R \approx I^2 \cdot (R_s - R) + 2\Delta I \cdot I R_s$$

When $I^2(R_s - R) << \Delta W$, the above equation can be approximated as:

$$\Delta W = 2\Delta I \cdot I R_s$$

from which ΔI can be solved as:

$$\Delta I \approx \frac{\Delta W}{2 I R_s}$$

Voltage Adjustment

In this embodiment, the electrical voltage (V) passed through the heated element is adjusted by an amount (ΔV) to achieve the adjustment in electrical power ΔW, wherein:

$$\Delta W = \frac{(V+\Delta V)^2}{R_s} - \frac{V^2}{R} \approx V^2 \cdot \left(\frac{1}{R_s} - \frac{1}{R}\right) + \frac{2\Delta V \cdot V}{R_s}$$

When $V^2(R_s^{-1} - R^{-1}) << \Delta W$, the above equation can be approximated as:

$$\Delta W = \frac{2\Delta V \cdot V}{R_s}$$

from which ΔV can be solved as:

$$\Delta V \approx \frac{R_s}{2V} \cdot \Delta W$$

In a preferred embodiment of the present invention, the electrical current adjustment is employed to achieve the desired adjustment of electric power supplied to the controlled element.

FIG. 1 shows a diagram of an AFC control system using electrical current adjustment and the Balanced AFC algorithm, as described hereinabove.

Specifically, the constant or setpoint electrical resistance value $R_S$ is provided as an input to the AFC system, while the real time electrical resistance R of the controlled element is monitored as the output. In order to maintain consistency between the input and output, the difference therebetween is detected by the AFC system and used as the error signal e ($=R_S - R$), which triggers activation of the feedback control loop depicted by the dotted gray lines.

The feedback control loop, once activated, calculates a control signal, i.e., the adjusted electric current $I_A$, based on the Balanced AFC algorithm and current adjustment algorithm in the "Control Signal Determination" box, for manipulating the controlled element and to reduce the error signal e.

The electrically heated element of the present invention may comprise a reaction-based gas sensor comprising two or more filaments, while one of such filaments comprises a catalytic surface that is capable of facilitating catalytic exothermic or endothermic reactions of a reactive gas at elevated temperatures, and the other comprises a non-reactive surface and functions as a reference filament for compensating fluctuations in ambient temperature and other operating conditions, as described by U.S. Pat. No. 5,834,627 to Ricco et al. for "CALORIMETRIC GAS SENSOR," the disclose of which is incorporated herein by reference in its entirety for all purposes.

In a preferred embodiment of the present invention, the gas sensor comprises a single filament sensor element that is devoid of any reference filament, which distinguishes from the dual-filament gas sensor disclosed by the Ricco patent.

The constant resistance operation of the filament-based gas sensor of the present invention is achieved by pre-heating such gas sensor in an inert environment that is free of reactive gas species, so as to provide a reference measurement of such filament sensor.

Specifically, the filament sensor is pre-heated in the inert environment for a sufficiently long period of time so as to achieve a steady state that is defined by stabilized heating efficiency and ambient temperature, as well as zero change in the temperature of such sensor.

The electrical resistance of such filament sensor at the steady state ($R_s$) is then determined and set as the constant or setpoint value to be maintained when the sensor is disposed in a reactive environment that potentially contains the reactive gas species of interest.

Subsequent maintenance of the constant resistance operation of the filament sensor in the reactive environment is achieved by the feedback control system or method described hereinabove.

For each gas detection cycle, the filament sensor is pre-heated, its electrical resistance determined, and then exposed to an environment potentially contains the reactive gas species. Therefore, the constant resistance value $R_s$ at which the sensor is maintained is reset for each detection cycle, which provides frequent update of any changes in such sensor, therefore effectively eliminating the measurement error caused by long-term drifting.

Moreover, the pre-heating of the filament sensor element sets electrical resistance of the sensor at the setpoint value and prepares such sensor for instantaneous detection of the reactive gas species.

Figure 2:
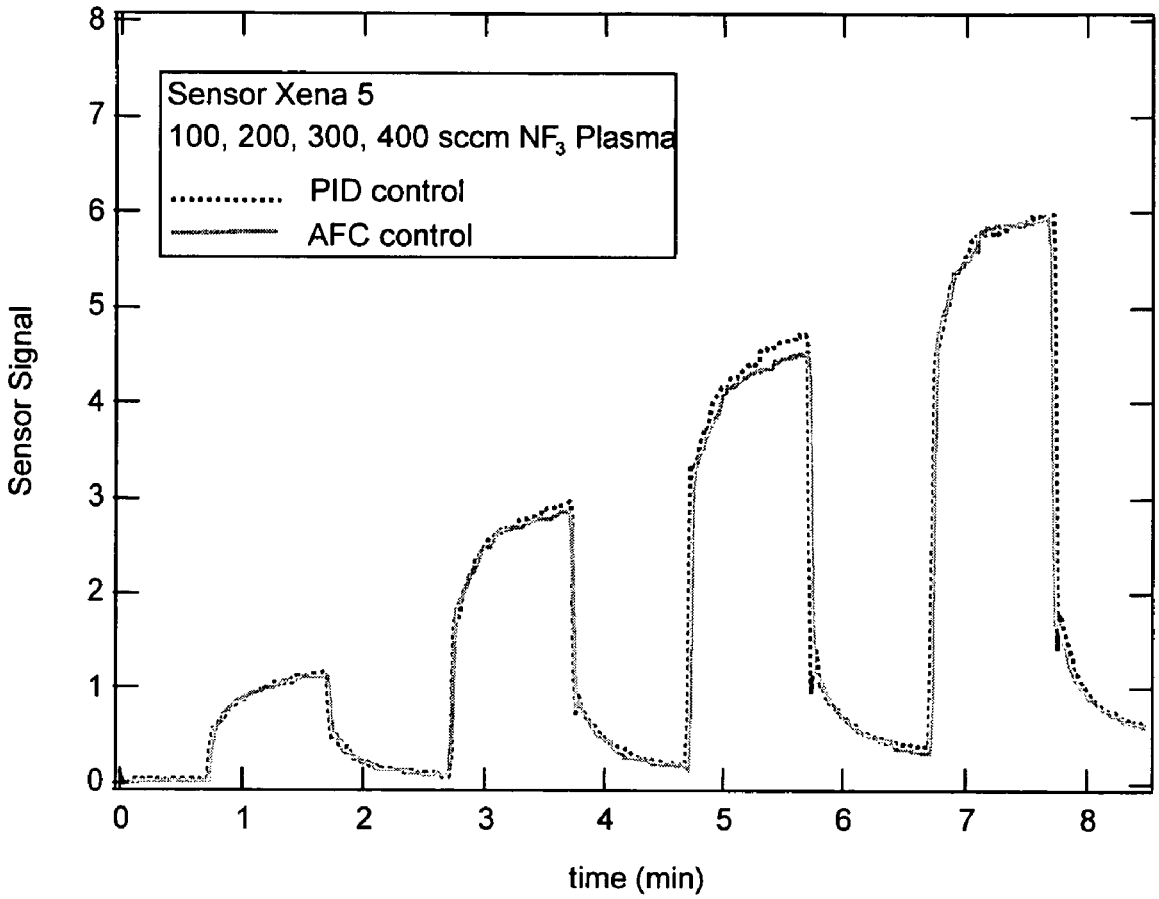
FIG. 2 shows the signal outputs generated by a Xena 5 gas sensor controlled by the adaptive feedback control (AFC) mechanism of FIG. 1, in comparison with signal outputs generated by the same sensor controlled by a conventional PID mechanism, in the presence of $NF_3$ gas at various flow rates (100 sccm, 200 sccm, 300 sccm, and 400 sccm).

FIG. 2 shows the signal output produced by a Xena 5 filament sensor, which is controlled by the AFC system as depicted in FIG. 1 during sequential exposure to four $NF_3$ plasma ON/OFF cycles having $NF_3$ flow rates of 100 sccm, 200 sccm, 300 sccm, and 400 sccm, respectively, in comparison with the signal output produced by the same Xena 5 filament sensor under the control of a conventional PID system.

The test manifold was operated at 5 Torr with a constant Argon flow of 1 slm. The plasma was ignited with argon, then $NF_3$ was alternately turned On and Off for 1 minute intervals at 100, 200, 300, and 400 sccm flow rates. The entire process was repeated twice on the same sensor: once under PID control and once under AFC control.

FIG. 2 indicates that the AFC signal output closely matches the PID signal, while the AFC system does not require any empirical tuning of the parameters. Further, the transient signal response produced by the AFC system is improved in comparison with that produced by the PID system.

Figure 3:
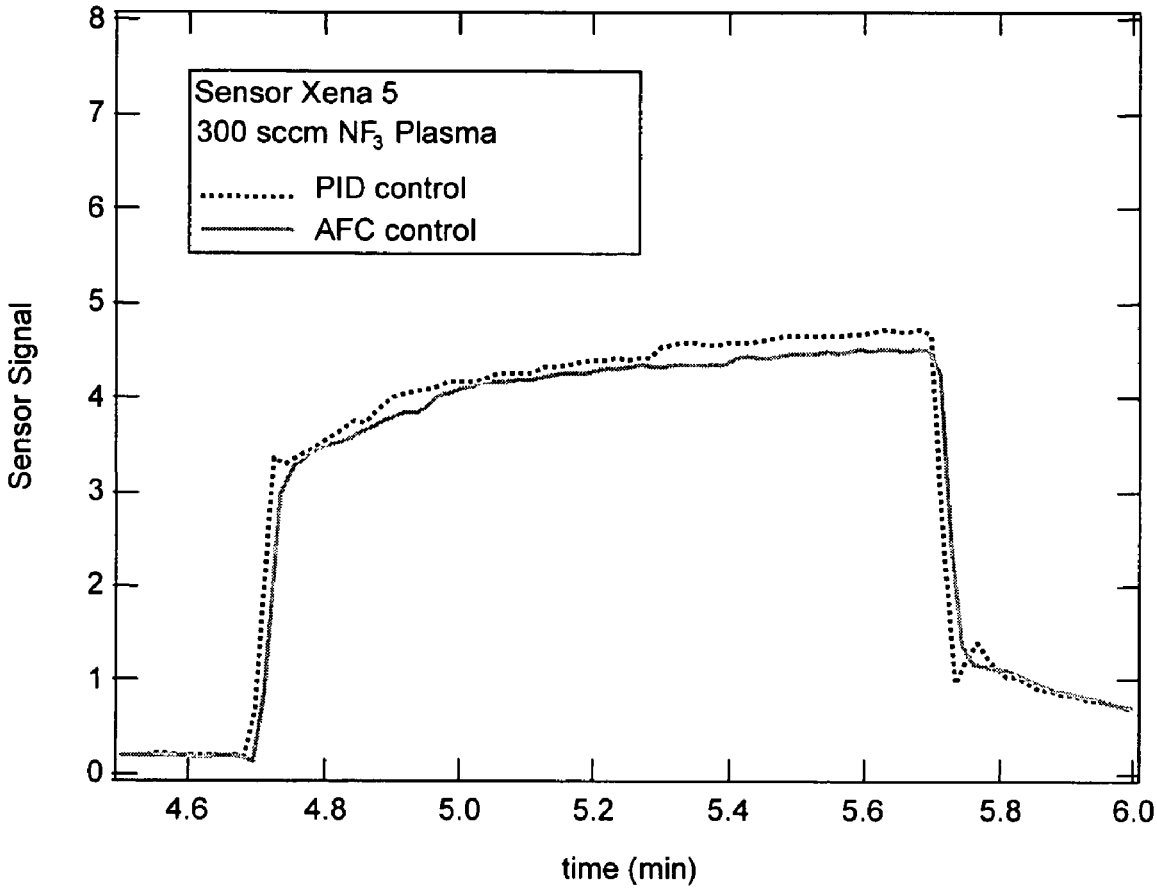
FIG. 3 shows the expanded signal outputs generated by the Xena 5 gas sensor of FIG. 2, in the presence of $NF_3$ gas at a flow rate of 300 sccm.

FIG. 3 shows the expanded signal outputs generated by the Xena 5 gas sensor of FIG. 2, in the presence of $NF_3$ gas at a flow rate of 300 sccm, while the transient response of the AFC system is clearly superior over that of the PID system.

While the invention has been described herein in reference to specific aspects, features and illustrative embodiments of the invention, it will be appreciated that the utility of the invention is not thus limited, but rather extends to and encompasses numerous other aspects, features and embodiments, as will readily suggest themselves to those of ordinary skill in the art, based on the disclosure herein. Accordingly, the claims hereafter set forth are intended to be correspondingly broadly construed, as including all such aspects, features and embodiments, within their spirit and scope.

What is claimed is:

1. A method for controlling electrical heating of an element to maintain a constant electrical resistance $R_S$, comprising:

(a) supplying electrical power to said element in an amount sufficient for heating same and increasing its electrical resistance to $R_S$, while concurrently monitoring real time electrical resistance R of said element for detection of any difference between R and $R_S$;

(b) upon detection of a difference between R and $R_S$, adjusting the electrical power supplied to said element by an amount ΔW determined approximately by:

$$\Delta W = \frac{m}{\alpha_\rho \times t \times R_0} \cdot (R_s - R); \quad \text{(i)}$$

-continued $$\Delta W = \frac{m}{\alpha_\rho \times R_0} \cdot [R_s + R(0) - 2R]; \quad \text{or} \quad \text{(ii)}$$

$$\Delta W = \frac{m}{\alpha_\rho \times R_0} \cdot \left[f_s(R_s - R) - \frac{R - R(0)}{t}\right], \quad \text{(iii)}$$

wherein m is the thermal mass of said element, $\alpha_p$ is the temperature coefficient of electrical resistance of said element, $R_0$ is the standard electrical resistance of said element measured at a reference temperature, t is the time interval between current detection of electrical resistance difference and last adjustment of electric power, R(0) is the electrical resistance of said element measured at last adjustment of electric power, and $f_S$ is a predetermined frequency at which the adjustment of electric power is periodically carried out;

wherein the element is heated under a constant power flux to cause the element to reach steady state.

2. The method of claim 1, wherein said element comprises an electrical gas sensor for monitoring an environment that is susceptible to presence of a target gas species, wherein said gas sensor comprises a catalytic surface for effectuating exothermic or endothermic reactions of said target gas species at elevated temperatures, so that the presence of said target gas species causes temperature change as well as electrical resistance change in said gas sensor, which responsively effectuates the adjustment of electrical power supplied to the gas sensor, wherein said adjustment of electrical power correlates to and is indicative of the presence and concentration of said target gas species in the environment.

3. The method of claim 2, wherein the gas sensor comprises a catalytic surface effective for producing exothermic or endothermic reaction of a target gas species.

4. The method of claim 2, wherein the gas sensor comprises a gas sensing filament.

5. The method of claim 2, wherein the gas sensor before sensing operation is heated in an inert environment to a steady state thermal condition, to establish a setpoint resistance value for said determining of the presence and/or concentration of the target gas species.

6. The method of claim 1 wherein the adjustment of electric power is carried out by adjusting electrical current passed through said element by an amount ΔI, determined approximately by:

$$\Delta I = \frac{\Delta W}{2IR_s},$$

wherein I is the electrical current passed through said element before the adjustment.

7. The method of claim 1 wherein the adjustment of electric power is carried out by adjusting electrical voltage applied on said element by an amount ΔV, determined approximately by:

$$\Delta V = \frac{\Delta W \cdot R_s}{2V},$$

wherein V is the electrical voltage applied on said element before the adjustment.

8. The method of claim 1, wherein ΔW is determined approximately by:

$$\Delta W = \frac{m}{\alpha_\rho \times t \times R_0} \cdot [R_s + R(0) - 2R].$$

9. The method of claim 8, wherein R(0) is approximately equal to $R_S$, and wherein ΔW is determined approximately by:

$$\Delta W = 2 \cdot \frac{m}{\alpha_\rho \times t \times R_0} \cdot [R_s - R].$$

10. The method of claim 2, wherein said electrical gas sensor comprises one or more filaments having a core formed of chemically inert material and having a coating formed of electrically conductive material.

11. The method of claim 1, wherein electrical current is adjusted to maintain said constant power flux.

12. The method of claim 1, wherein electrical voltage is adjusted to maintain said constant power flux.

13. The method of claim 3, further comprising use of a compensator filament devoid of a catalytic surface to compensate a signal of the gas sensor for changes in ambient conditions.

14. The method of claim 4, wherein the filament has a core comprising nickel.

15. The method of claim 4, wherein the filament has a critical dimension or diameter in a range of from about 0.1 μm to about 0.5 μm.

16. The system method of claim 4, wherein the filament has an exterior surface comprising nickel.

17. The system method of claim 16, wherein the filament has a diameter in a range of from about 0.1 μm to about 0.5 μm.

18. The method of claim 2, wherein said electrical gas sensor includes at least one filament having an exterior surface comprising nickel.

19. The method of claim 2, wherein said electrical gas sensor includes at least one filament comprising a noble metal.

* * * * *

UNITED STATES PATENT AND TRADEMARK OFFICE

CERTIFICATE OF CORRECTION

PATENT NO. : 7,655,887 B2
APPLICATION NO. : 11/440241
DATED : February 2, 2010
INVENTOR(S) : Chen et al.

It is certified that error appears in the above-identified patent and that said Letters Patent is hereby corrected as shown below:

On the title page item (*) Notice, after 75 days add: -- This patent is subject to a terminal disclaimer. --.

Page 2, References Cited, U.S. Patent Documents, add: -- 2004/0086023 A1 5/2004 Smith, et al. --.

Column 2, line 48: "($K_P$, $K_I$, and $K_D$)" should be -- ($K_P$, $K_I$, and $K_D$) --.

Column 8, line 33: "$R = R_0 \cdot \lfloor l + \alpha_\rho (T - T_0) \rfloor$" should be -- $R = R_0 \cdot \lfloor 1 + \alpha_\rho (T - T_0) \rfloor$ --.

Signed and Sealed this

Sixth Day of July, 2010

David J. Kappos

David J. Kappos
*Director of the United States Patent and Trademark Office*